United States Patent [19]

Kaplan

[11] Patent Number: 4,471,634

[45] Date of Patent: Sep. 18, 1984

[54] PLURAL SECTION RING SIZER

[76] Inventor: Sol Kaplan, 63 Crestmont Rd., West Orange, N.J. 07052

[21] Appl. No.: 461,030

[22] Filed: Jan. 26, 1983

[51] Int. Cl.[3] ..... A41C 9/02
[52] U.S. Cl. ..... 63/15.6
[58] Field of Search ..... 63/15.6

[56] References Cited

U.S. PATENT DOCUMENTS

| | | | |
|---|---|---|---|
| 2,745,265 | 5/1956 | Grafstein | 63/15.6 |
| 2,745,266 | 5/1956 | Grafstein | 63/15.6 |
| 2,778,207 | 1/1957 | Thaler | 63/15.6 |
| 3,483,718 | 12/1969 | Lodrini | 63/15.6 |

FOREIGN PATENT DOCUMENTS

| | | | |
|---|---|---|---|
| 1140768 | 12/1962 | Fed. Rep. of Germany | 63/15.6 |

*Primary Examiner*—F. Barry Shay
*Attorney, Agent, or Firm*—Goodman & Teitelbaum

[57] ABSTRACT

A ring sizer which can be inserted into an inside circumference of a band portion of a ring in order to self adjust the ring size to a wearer's finger, the ring sizer including a plurality of elongated body sections having their end portions nestingly arranged with respect to each other. Each of the body sections is constructed to straddle the band portion of the ring. An arcuately shaped leaf spring functions as a retaining bar for supporting all of the body sections in a longitudinally adjacent relationship, with the body sections thereby forming an arcuate configuration. An arcuately shaped leaf spring functions as a biasing bar, which is curved in an opposing direction to the retaining bar to engage the ring band portion so that the arcuate configuration of the body sections conforms to the wearer's finger.

16 Claims, 10 Drawing Figures

PLURAL SECTION RING SIZER

BACKGROUND OF THE INVENTION

This invention relates to rings, and more particularly to a ring sizer which can fit within the inner circumference of the band portion of a ring and permits self adjustment of the ring to the wearer's finger.

Although in many situations, a ring is specifically sized for the wearer's finger, in many situations, the ring size must be adjusted in order to fit the wearer. For some adjustments, the ring will actually be cut and resized to the correct finger size. However, in most situations, a ring guard or sizer is placed on the ring in order to provide the necessary adjustment to accommodate the wearer's finger. Most ring guards, however, are of a fixed dimension and accordingly will be set for a particular finger size. However, this may not always comfortably fit the particular size of the finger.

Accordingly, there has been provided various adjustable ring guards which can be inserted into a ring to provide self adjustment for the wearer's finger. One such adjustable ring guard is described in U.S. Pat. No. 3,483,718. In that device, a saddle-like insert is fitted into the ring and is upwardly biased, but is retained in place by means of notches or similar alterations which are formed directly into the ring. While this device does provide self-adjustment, alteration of the ring is required by carving notches or other modifications therein in order to accommodate the ring sizer.

Other devices available for self-adjustment of the ring size are described, by way of example, in U.S. Pat. Nos. 2,745,265 and 2,745,266, as well as 2,778,207. However, in all of these devices, there is provided an insert which fits within a specially designed recess provided beneath the gem setting and requires special configuration of the ring in order to accommodate the insert. These devices are therefore limited to only certain types of rings having the special recess and appropriate configuration.

There is accordingly still needed a ring sizer which can suitably fit into a standard ring without having a specially designed configuration therein, and without requiring modification of the ring itself. The ring sizer should be of the type to permit self adjusting to the finger size of the wearer and should be easily inserted, as well as removed from the ring.

SUMMARY OF THE INVENTION

It is accordingly, an object of the present invention to provide a ring sizer which is insertable on the inside circumference of the band portion of a ring, and which avoids the aforementioned problems of prior art devices.

A further object of the present invention is to provide a ring sizer which can fit into any standard ring, and which will be self-adjusting to the finger size of the wearer.

Still a further object of the present invention is to provide a ring sizer which can be easily inserted, as well as removed from the inside circumference of the band portion of a ring, and which provides adjustment for the size of the wearer's finger.

Yet a further object of the present invention is to provide a ring sizer which can be easily inserted into a ring, adjusted to the wearer's finger, and retained at the particular adjusted size.

Still another object of the present invention is to provide, in combination, a ring with a self-adjusting ring sizer for fitting onto a wearer's finger.

Briefly, in accordance with the present invention, there is provided a ring sizer which can be inserted onto the inside circumference of the band portion of a ring. The ring sizer includes a plurality of elongated body sections which are adjacently arranged with respect to each other. Each of the body sections has a substantially U-shaped cross sectional configuration. The body sections serve as a saddle which straddles the band portion of the ring. An arcuately shaped leaf spring retaining bar is provided. The retaining bar is curved in the same direction as the band portion of the ring and supports the plurality of elongated body sections in adjacent relationship with each other and in an arcuate configuration. There is also provided an arcuately shaped leaf spring biasing bar which is curved in a direction opposite from that of the retaining bar. The biasing bar conforms the arcuate configuration of the body sections to that of the wearer's finger.

In order to provide for a nesting relationship between the body sections, the abutting edges of adjacent body sections are arcuately shaped in complementary fashion with respect to each other. In this manner, the nesting relationship is achieved in all of the various arcuate configurations of the body sections for all finger sizes.

The present invention further contemplates the combination of a ring having a circular band portion with an inner circumference, and the ring sizer as previously mentioned.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DESCRIPTION OF THE PREFERRED EMBODIMENTS

Figure 1:
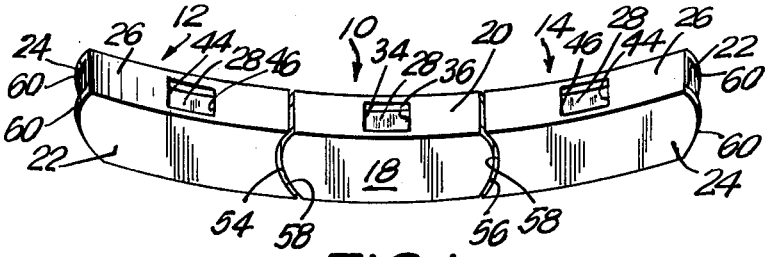
FIG. 1 is a perspective view of the body sections assembled into an arcuate configuration to provide a ring sizer in accordance with the present invention.
Figure 2:
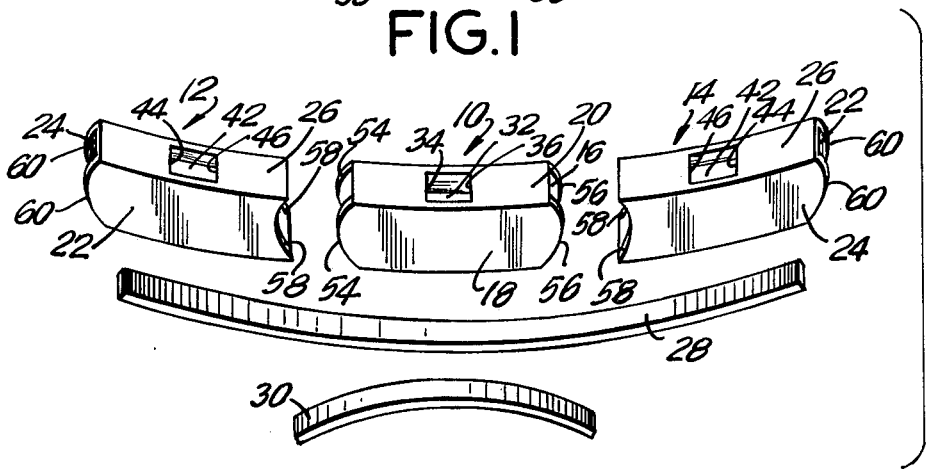
FIG. 2 is an exploded perspective view of the various parts forming the ring sizer.

Referring now to FIGS. 1 and 2, there is shown the ring sizer of the present invention having an arcuate shape which comprises a plurality of individual body sections including a central body section 10 and lateral body sections 12 and 14. The central body section 10 is formed of a substantially U-shaped cross sectional configuration including opposing side walls 16, 18, interconnected by an arcuately shaped bight portion 20. The lateral body sections 12 and 14 are shown to be substantially identical to each other, and are positioned on the ring sizer in reverse relationship on opposite ends of the central body section 10. Each of the lateral body sections 12, 14 comprises opposing side walls 22, 24 interconnected by an arcuately shaped bight portion 26.

The ring sizer also includes an arcuately shaped, leaf spring retaining bar 28. The curvature of the retaining bar 28 is in the same arcuate direction as the ring sizer, and also as that of the band portion of the ring in which the ring sizer is to be inserted. There is also provided an arcuately shaped leaf spring biasing bar 30. However, the curvature of the biasing bar 30 is in the opposite direction from that of the retaining bar 28. It should be noted that the length of the retaining bar 28 is such as to be substantially equal to the combined length of the body sections 10, 12 and 14. On the other hand, the length of the biasing bar 30 is slightly more than or approximately the same as the length of only the central body section 10.

Figure 3:
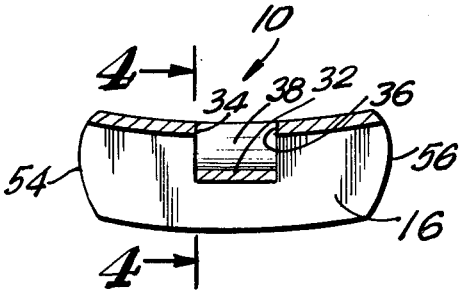
FIG. 3 is an elevational sectional view of the centrally located body section, showing a strap provided therein for supporting the leaf springs.

As is best shown in FIG. 3, a strap 32 is formed beneath the bight portion 20 of the central body section 10, but only extends across a part of the length of the bight portion 20. The strap 32 is depressed beneath the bight portion 20.

Figure 4:
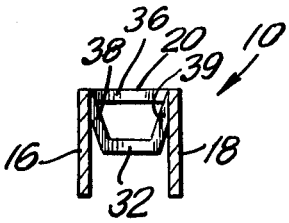
FIG. 4 is a cross sectional view taken along line 4—4 of FIG. 3, showing the construction of the strap of the central body section.
Figure 5:
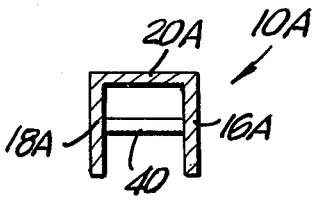
FIG. 5 is a cross sectional view similar to that shown in FIG. 4, showing another construction of the strap of the central body section.

One method of forming the bight portion 32, is shown best in FIG. 4 and includes cutting the bight portion along lateral edges 34,36 which are longitudinally spaced apart along the bight portion 20. The strap 32 can then be swedged down from the bight portion 20 so that angled side supporting walls 38, 39 are formed which support the strap 32. An alternate method of forming the strap, is as shown in FIG. 5, wherein strap 40 has been inserted beneath the bight portion 20A of the central body section 10A, and positioned between the side walls 16A, 18A. Strap 40 can be retained in place by soldering, or other fastening method. It should again be noted, that the strap 40 need not extend the full elongated length of the central body section 10A, but need only be positioned beneath a part of the bight portion 20A.

Figure 6:
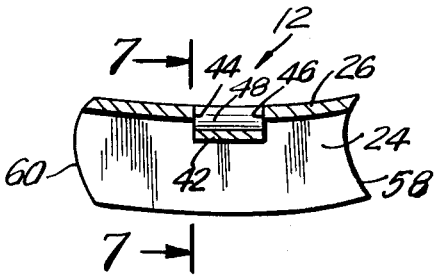
FIG. 6 is an elevational sectional view of a side body section, showing a strap provided therein.

Referring now to FIG. 6, it is shown that a strap 42 is also formed beneath the bight portion 26 of the lateral side body section 12. It should be understood, that a similar strap 42 would be formed beneath the other lateral side section 14, which is identical to the side body section 12.

Figure 7:
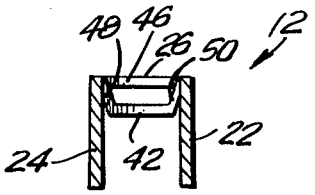
FIG. 7 is a cross sectional view taken along line 7—7 of FIG. 6, showing the construction of the strap of the side section.

As shown in FIG. 7, one method of forming the strap 42 is by cutting the transverse lateral edges 44, 46 which are longitudinally spaced apart along the bight portion 26, and then swedging down the portion 42. The swedged down strap 42 is supported by the angled side walls 48, 50 formed during the swedging operations.

Figure 8:
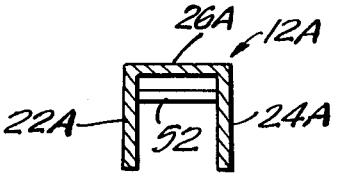
FIG. 8 is a cross sectional view similar to that shown in FIG. 7, showing another construction of the strap of the side section.

As shown in FIG. 8, a strap 52 can also be formed by securing it between the side walls 22A, 24A of the side body section 12A and positioning it beneath the bight portion 26A. The strap 52 can be retained in place by means of soldering, or other fastening means.

Referring again to FIGS. 1 and 2, the lateral ends of the central body section 10 are outwardly bowed as shown at 54, 56. The ends of the lateral side body sections 12, 14, which align with the bowed ends 54, 56 are curved in an opposite direction to mate with the curved ends 54, 56. Specifically, the curves in the mating ends of the lateral body sections are inwardly directed at 58. The distal ends of the lateral body sections are outwardly bowed, as shown at 60.

As can best be seen by comparing FIGS. 4 and 6, it is noted that the strap 32, which is positioned beneath the bight portion 20 of the central body section 10, is located at a lower level than the strap 42, which is positioned beneath the bight portion 26 of the side body sections 12, 14. The space between the straps 32, 42 and the respective bight portions, define a channel for receiving the retaining bar 28. Accordingly, the thickness of the retaining bar 28 is such as to snugly fit between the channel space provided between the strap 42 and the bight portion 26 of the side body sections 12, 14 as shown in FIG. 6. The space of the channel provided in the central body section 10, is such as to accommodate not only the retaining bar 28, but also the biasing bar 30. Both of these bars 28, 30 snugly fit in the channel formed between the strap 32 and the bight portion 20 of the central body section 10.

Figure 9:
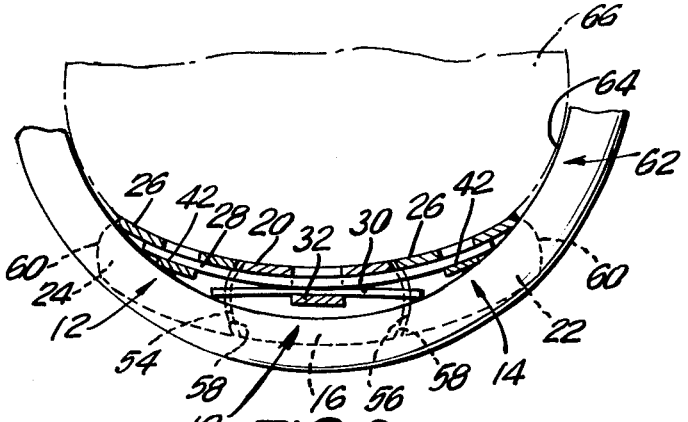
FIG. 9 is a sectional view of the ring sizer placed in a partially broken away ring, showing the sizer adjusted for one ring size.

Accordingly, as can best be seen in FIG. 9, the retaining strap 28 substantially extends the length of all three sections 10, 12, 14. Furthermore, it snugly fits in the channel provided by all these three sections and therefore retains all the sections together in an arcuate relationship conforming to its own arcuate curvature.

On the other hand, the biasing bar 30 only extends substantially beneath the central section 10, where it may extend slightly outwardly therefrom, and fits between the strap 32 and the retaining bar 28. Accordingly, it serves to bias upwardly the retaining bar 28, and therefore suitably modify the arcuate configuration provided by the retaining bar 28.

With the arcuate sections assembled so that the retaining bar 28 passes through all the body sections 10, 12 and 14, and the biasing bar extends substantially beneath only the central section 10, the ring sizer can now be suitably placed within a ring.

As shown in FIG. 9, the assembled ring sizer is placed onto the inner surface 64 of the band portion 62 of a finger ring. The sections 10, 12, 14 are retained adjacent to each other and in an arcuate configuration by means of the retaining bar 28. With a finger 66 inserted within the ring, the biasing bar 30 will engage the band portion 62 and push upwardly against the retaining bar 28 causing the arcuate configuration of the three sections 10,12, 14 to abut against the finger 66. The arcuate sections 10, 12, 14 are retained in their arcuate configuration by means of the retaining band 28 passing through all of the sections. Because of the arcuately shaped interfitting edges 54, 56, 58 of adjacent body sections, regardless of the configuration, the adjacent sections are retained together and in a smooth arcuate shape.

Figure 10:
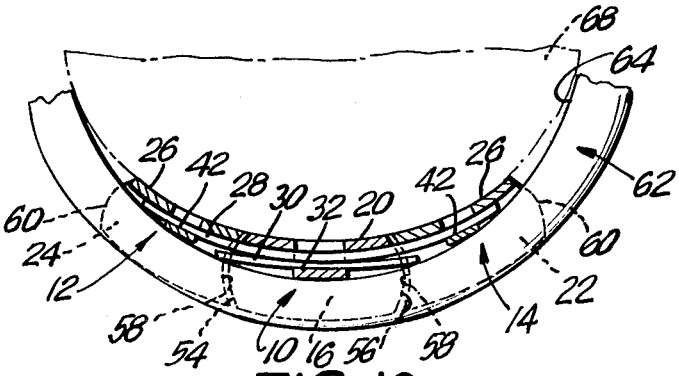
FIG. 10 is a sectional view similar to that shown in FIG. 9, showing the ring sizer adjusted for a larger finger size.

As shown in FIG. 10, when a larger finger 68 is inserted within the ring, the ring sizer has modified its arcuate configuration. This can best be seen by noting the reduced arcuate shape of the biasing bar 30. In FIG. 9, where a smaller size finger is inserted, the biasing bar 32 shows a substantial arcuate configuration. On the other hand, in FIG. 10, where a larger finger 68 is inserted, the biasing bar 30 is almost horizontal.

The corresponding arcuate configuration of the three body sections 10, 12, 14 will also differ based upon the finger size. In each case, however, the body sections will be moved to abut the finger, and will provide an arcuate configuration conforming to that finger size. Yet, in each case, a nesting relationship is still provided between the adjacent body sections because of the complementary arcuate configuration of the abutting edges between the body sections.

Once the finger size is achieved, the ring sizer of the present invention can be retained in place by means of providing a tight fit of the body sections straddling across the ring. Accordingly, the width of each body section, and specifically, the width of the bight portion of each body section, will be correspondingly sized dependent upon the width of the ring on which it is being inserted. For a wider ring band, a wider bight portion is provided. This will give a snug fit of the body sections onto the band portion of the ring and will keep the ring sizer in place.

Alternately, it is possible to crimp the side walls of each of the body sections against the ring band portion once a particular desired size is achieved. This will insure that the ring size will remain on the ring band portion. The side walls of the body sections are therefore slightly flexible in order to permit straddling of the ring band portion and to permit crimping thereof against the ring band portion.

It should also be appreciated, that the ring sizer can be easily inserted into an existing ring in order to modify its size, as desired. Alternately, the ring can be initially provided with the ring sizer already fitting in place to permit accommodation of various finger sizes for that ring.

Although only three body sections are shown, it should be appreciated that additional lateral body sections 12, 14 could be provided. The length of the retaining bar 28 would vary in accordance with the number of sections provided in order to retain the sections together. However, because of the arcuate edges 58, 60 of each lateral body section 12, 14, all of these plurality of body sections would still interfit with each other and provide a smooth arcuate configuration conforming to the finger size desired.

The material from which the ring sizer is constructed could typically be of a precious metal, such as silver or gold. It could also be made of plastic or other firm material.

The outer edge 60 of the lateral sections is rounded in order to avoid any cutting or scratching of the wearer's finger. The height of the side walls of the body sections is made so that in the maximum sized position, as for example shown in FIG. 10, the sections will not depend beneath the lower edge of the band portion of the ring.

Thus, as shown in FIG. 10, with the ring sizer being in its maximum position, the height of the side walls of each of the sections are therefore equal to, or slightly less than the height of the ring band portion 62. In this way, in its maximum size, the ring sizer will not extend beneath the peripheral limit of the ring itself. Preferably, the bottom edges of the side walls of each of the sections are arcuately shaped the same as the respective bight portions 20, 26 to conform to the peripheral limit of the ring in its maximum size, as shown in FIG. 10.

Numerous alterations of the structure herein disclosed will suggest themselves to those skilled in the art. However, it is to be understood that the present disclosure relates to preferred embodiments of the invention which are for purposes of illustration only and are not to be construed as a limitation of the invention.

What is claimed is:

1. A ring sizer, insertable on an inside circumference of the band portion of a ring, comprising:

a plurality of elongated, mutually discrete body sections having end portions nestingly arranged in a longitudinal direction with respect to each other, each body section having a substantially U-shaped cross sectional configuration defining a saddle for straddling the band portion of the ring;

retaining means including an arcuately shaped leaf spring retaining bar, said retaining bar being curved in the same direction as the band portion of the ring for supporting said body sections longitudinally adjacent to each other in an arcuate configuration; and biasing means including an arcuately shaped leaf spring biasing bar, said biasing bar being curved in an opposite direction from the retaining bar for engaging the ring band portion to conform the arcuate configuration of said body sections to the wearer's finger.

2. A ring sizer as in claim 1, wherein said retaining bar is coupled to all of said body sections, and wherein said biasing bar is coupled to only a centrally located one of said body sections.

3. A ring sizer as in claim 2, wherein each of said body sections includes a pair of side walls interconnected by a bight portion, and further including a strap member supported below said bight portion of each body section, the plurality of strap members of said body sections together with said bight portions thereby defining aligned channels for receiving and holding said retaining bar, the channel within the centrally located body section also receiving and holding said biasing bar.

4. A ring sizer as in claim 3, wherein said strap members include a swedged-down section of said bight portion of each body section, said swedged down portion of said centrally located body section extending a greater distance below its bight portion than the strap members of the other body sections.

5. A ring sizer as in claim 4, wherein said strap members are bounded by parallel transverse cuts along the bight portions of each body section.

6. A ring sizer as in claim 3, wherein said strap members include a shelf extending between a portion of the side walls of each body section, the shelf of the centrally located body section being positioned at a lower level with respect to its bight portion then the shelf of the other body sections.

7. A ring sizer as in claim 1, wherein abutting edges of said end portions of adjacent body sections are matingly curved with respect to each other to thereby provide the nesting relationship in all arcuate configurations of said body sections.

8. A ring sizer as in claim 7, wherein lateral edges of said end portions of a centrally located one of said body sections are outwardly curved.

9. A ring sizer as in claim 1, comprising three body sections including a central body section and two substantially identical lateral body sections on opposite longitudinal ends thereof, all said body sections lying along a common arcuate path.

10. A ring sizer as in claim 9, wherein lateral ends of said end portions of said central body section are outwardly curved, abutting ends of said two body sections being matingly curved in an opposing direction, and outer ends of said two body sections being outwardly curved.

11. A ring sizer as in claim 9, wherein said retaining bar extends through all of said three body sections, and said biasing bar extends through only said central body section.

12. In combination, a finger ring having a circular band portion with an inner circumferential surface and side walls, and a ring sizer, said ring sizer comprising:

a plurality of elongated mutually discrete body sections having end portions nestingly arranged in a longitudinal direction with respect to each other, each body section having a substantially U-shaped cross sectional configuration defining a saddle for straddling the band portion of the ring;

retaining means for supporting said body sections longitudinally adjacent to each other in an arcuate configuration, said retaining means including an arcuately shaped leaf spring; and biasing means for conforming the arcuate configuration of the body sections to the wearer's finger, said biasing means including an arcuately shaped leaf spring.

13. A combination as in claim 12, wherein each of said body sections includes a pair of side walls interconnected by a bight portion, said bight portion being of a size to snugly fit over said band portion of said finger ring, and the height of said side walls of said body sections being less than the height of said side walls of said finger ring.

14. A combination as in claim 12, wherein said ring sizer fits into a lower half of said finger ring.

15. A combination as in claim 13, wherein said side walls of said body sections are flexible and provide a snug fit onto said finger ring.

16. A combination as in claim 15, wherein said side walls of said body sections are capable of being crimped onto said side walls of said finger ring.

* * * * *